United States Patent [19]

Rivoir

[11] Patent Number: 4,746,889

[45] Date of Patent: May 24, 1988

[54] METHOD OF MAKING A MAGNET ARRANGEMENT AND MAGNET ARRANGEMENT MADE BY THE METHOD

[76] Inventor: Karl H. Rivoir, Am Nagoldhang 5, 7350 Pforzheim, Fed. Rep. of Germany

[21] Appl. No.: 84,450

[22] Filed: Aug. 11, 1987

[30] Foreign Application Priority Data

Aug. 27, 1986 [DE] Fed. Rep. of Germany ..... 3629085

[51] Int. Cl.[4] ..... H01F 7/00

[52] U.S. Cl. ..... 335/296; 335/302; 29/607

[58] Field of Search ..... 335/296, 297, 302; 29/602 R, 607

[56] References Cited

U.S. PATENT DOCUMENTS

| | | | |
|---|---|---|---|
| 3,585,550 | 6/1971 | Dorsch | 335/302 |
| 3,810,056 | 5/1974 | Jereb | 335/302 |
| 4,383,193 | 5/1983 | Tomite et al. | 335/302 X |

*Primary Examiner*—George Harris

*Attorney, Agent, or Firm*—Toren, McGeady & Associates

[57] ABSTRACT

A method of making a magnet arrangement including a cylindrical magnet, pole shoes surrounding and resting against the magnets, the pole shoes formed of hollow cylinder sections, and two cover plates placed on the end faces of the magnet and the pole shoes, wherein the cover plates are connected to the pole shoes. The inner surfaces of the pole shoes facing the magnet have, before being placed on the magnet, a radius different from the radius of the outer cylindrical surface on the magnet. The magnet arrangement is obtained by placing the pole shoes against the magnet, pressing the pole shoes against the magnet until the radius of the outer surface of the magnet and the radius of the inner surfaces of the pole shoes are equal, and welding the cover plates and the pole shoes together. In the resulting magnet arrangement, the finish of the magnet must not need narrow tolerances, and it is ensured that no air gaps exist between the inner surfaces of the pole shoes and the outer surface of the magnet.

9 Claims, 3 Drawing Sheets

METHOD OF MAKING A MAGNET ARRANGEMENT AND MAGNET ARRANGEMENT MADE BY THE METHOD

BACKGROUND OF THE INVENTION

1. Field of the Invention

The present invention relates to a method of making a magnet arrangement. The magnet arrangement includes a cylindrical magnet and pole shoes or pole pieces surrounding and resting against the magnet. The pole shoes are formed of hollow cylinder sections. Two cover plates are placed on the end faces of the magnet and of the pole shoes. The cover plates and the pole shoes are connected.

The present invention further relates to the magnet arrangement obtained by the method.

2. Description of the Prior Art

A magnet arrangement of this type is known from German Utility Model No. 6,750,056. In this magnet arrangement, the pole pieces are loosely placed around a magnet core. The cover plates are constructed as clamping pieces which are clamped together with pole pieces. This magnet arrangement has the disadvantage that either the inner surfaces of the pole pieces or the outer surfaces of the magnet must have a very exact finish and their radii must be adjusted to each other, in order to achieve the magnetically required full surface area contact between the inner surfaces of the pole pieces and the outer surface of the magnet. However, such an exact finishing is relatively expensive, particularly of the outer surface of the magnet. If the expense for finishing the surface is not or cannot be incurred, the magnet arrangement has the disadvantage that air gaps are created between the inner surfaces of the pole pieces and the outer surface of the magnet. This impairs the efficiency of the magnet arrangement and the linearity of the magnetic flux. In addition, the clamping connection of the cover plates with the pole pieces is difficult to manufacture and not sufficiently rigid.

German Utility Model No. 6,802,788 discloses a similar magnet arrangement which is also assembled in a similar manner, except that the cover plates are made of plastics material and the plastics material is injected in such a way that the plastics material penetrating into the recesses or undercuts of the pole shoes holds the arrangement together. The disadvantages of this magnet arrangement are essentially the same as that of the magnet arrangement disclosed in German Utility Model No. 6,750,056.

French Laid-Open Application No. 2,538,121 discloses a magnet arrangement in which the inner magnet is block-shaped. The pole pieces have a cross-section which has the shape of a segment of a circle. The front elevational view of the pole pieces is rectangular, wherein the rectangle fits together with the corresponding plane countersurface of the block-shaped magnet. After the pole pieces have been fixed in a certain position, the magnet is slid between the pole pieces. The cover plates are then placed on the magnet and pole pieces and are connected to the pole pieces by gluing or welding. Because of the different shape of the magnet, the magnet arrangement according to the French reference is not comparable to the type of magnet arrangement according to the invention. In addition, the shapes of the magnet and of the pole pieces must be finished very exactly and, therefore, this magnet arrangement has the same disadvantages as those discussed above.

It is, therefore, the primary object of the present invention to provide a method of making a magnet arrangement in which it is not necessary to meet narrow tolerances in finishing the pole shoes and particularly the magnet. In addition, in the finished magnet arrangement, no air gaps are to exist between the inner surfaces of the pole shoes and the outer surfaces of the magnet.

SUMMARY OF THE INVENTION

In accordance with the present invention, the inner surfaces of the pole shoes facing the magnet have before being placed on the magnet a radius different from the radius of the outer cylindrical surface of the magnet. The pole shoes are placed on the magnet by pressing the pole shoes against the magnet until the radius of the outer surface of the magnet and the radius of the inner surfaces of the pole shoes are equal. Finally, the cover plates and the pole shoes are welded together.

In the magnet arrangement according to the present invention, it is possible to use magnets which are unpolished or only inaccurately polished. Also, the dimensional tolerances of the inner surfaces of the pole shoes can be greater because, after the pole shoes have been pressed against the magnet, the inner surfaces of the pole shoes rest fully against the outer surface of the magnet, i.e., no air gaps exist between the outer surface of the magnet and the inner surfaces of the pole shoes. In other words, the radius of the inner surfaces of the pole shoes becomes exactly the same as the radius of the outer surface of the magnet, When the pole shoes are in the position relative to the magnet described above, the cover plates are welded to the pole shoes, so that the pole shoes are held absolutely rigidly and immovably in the pressed-on position. Since the pole shoes have been pressed on against the magnet, the resulting tension in the pole shoes seeks to return the pole shoes into their original shape in which the radius of the inner surfaces of the pole shoes is different from the radius of the outer surface of the magnet. Accordingly, the cover plates serve the function of carrier members welded to the pole shoes.

Magnet arrangements in accordance with the present invention are primarily used in measuring elements for electric measuring instruments. In such measuring elements, the magnet is the most expensive component. Since the invention makes it possible to reduce the manufacturing costs of the magnet by about half without negatively affecting the operation of the magnet, and since, thus, the manufacturing costs of the magnet arrangement can be reduced accordingly, the measuring element itself also becomes less expensive to manufacture.

In accordance with the present invention, before the magnet arrangement is being assembled, the radius of the inner surfaces of the pole shoes may be smaller or greater than the radius of the outer surface of the magnet.

As mentioned above, the present invention is also directed to a magnet arrangement made by the method described above. In this magnet arrangement, the pole shoes rest under tension with their inner surfaces fully against the outer surface of the magnets. Cover plates are placed on end faces of the magnet and of the pole shoes. Welded connections connect the cover plates with the pole shoes.

In accordance with a feature of the present invention, at least one welded connection is provided near each side surface of the pole shoes. In other words, the welded connections are provided in those locations where the tension of the pole shoes is the greatest. Thus, an unintentional and disadvantageous return of the pole shoes in their initial positions is securely prevented.

In accordance with another feature of the invention, the magnet is unpolished or only coarsely polished. As a result, the manufacturing costs of the magnet are low.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
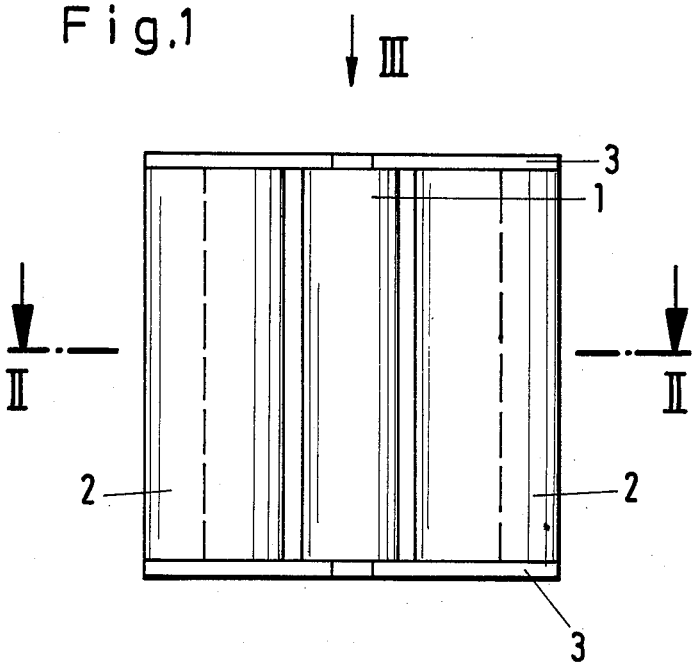
FIG. 1 is an elevational side view of a first embodiment of the magnet arrangement according to the invention.
Figure 2:
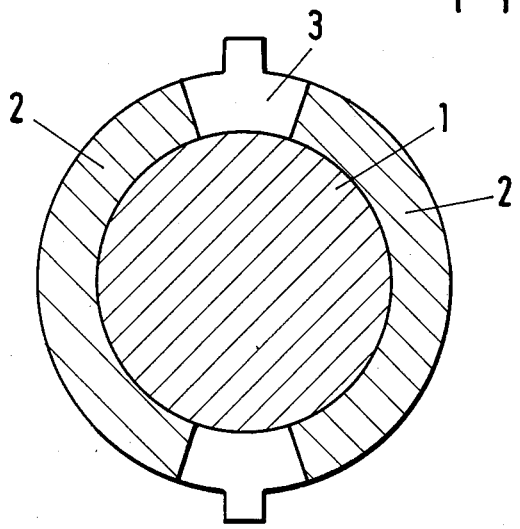
FIG. 2 is a sectional view taken along sectional line II—II of FIG. 1.
Figure 4:
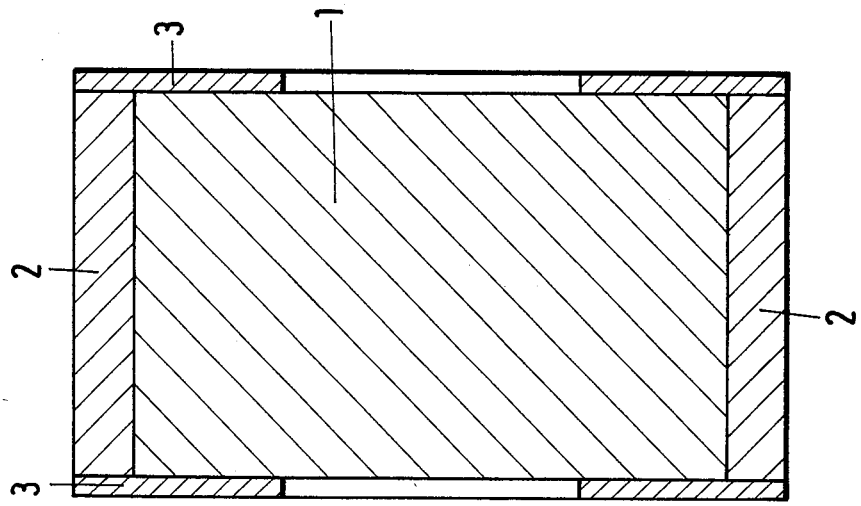
FIG. 4 is a sectional view taken along sectional line IV—IV in FIG. 3.

As illustrated in the drawing, the magnet arrangement according to the invention includes a cylindrical magnet 1, two poles shoes 2 and two cover plates 3. The pole shoes 2 are hollow cylinder sections which rest against the magnet over a substantial portion of the circumference of the magnet, either from the side or from the top and bottom, as illustrated in FIG. 3.

Figure 3:
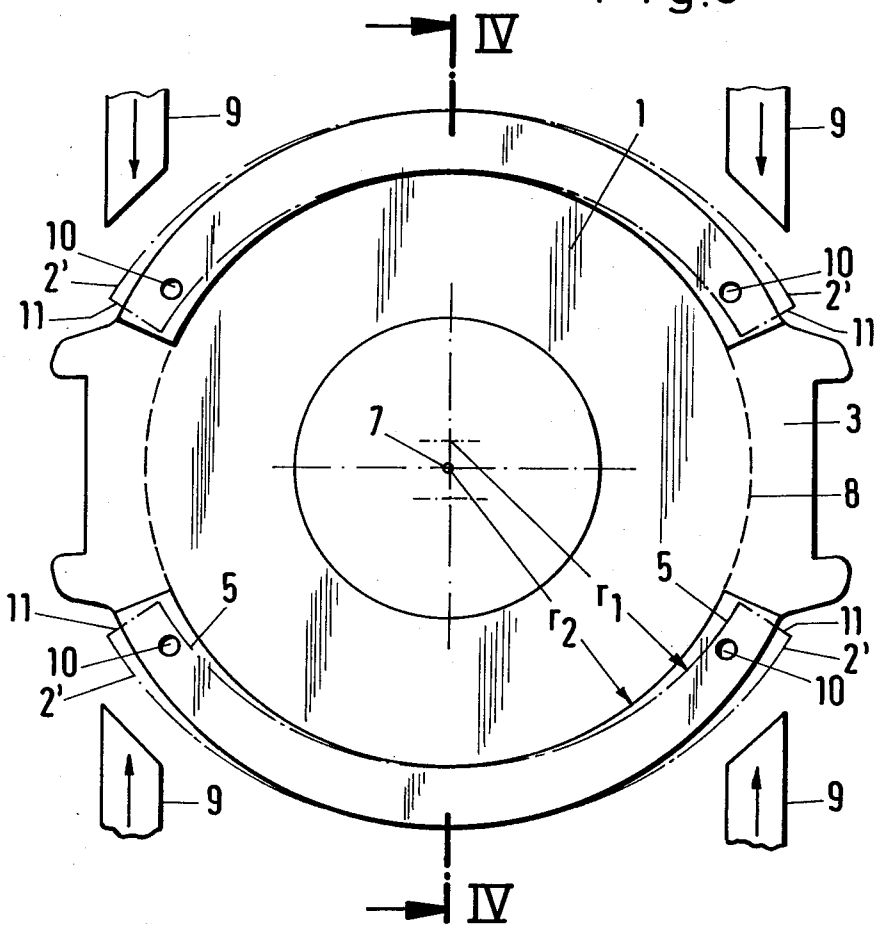
FIG. 3 is a top view of the embodiment of FIG. 1, as seen in the direction of arrow III of FIG. 1.

In the embodiment of the magnet arrangement according to the invention illustrated in FIG. 3, the pole shoes prior to being mounted have a radius r1 at their inner surfaces 5. The center point of radius r1 is somewhat offset relative to the center point 7 of the entire magnet arrangement. Radius r1 is greater than radius r2 of outer surface 8 of the magnet. The center point of radius r2 is identical with the center point 7 of the entire arrangement. The shape of the pole shoes prior to assembly is shown in FIG. 3 in dash-dot lines at 2'.

An appropriate, schematically illustrated device or tool 9 is used to press the pole shoes which have the greater radius r1 against the outer surface 8 of the magnet until the pole shoes reach the position illustrated in solid lines. The device 9 maintains the pressure on the pole shoes until the cover plates 3 are placed on the magnet and pole shoes and are welded to the pole shoes. The welded connections between the cover plate and the pole shoes are preferably spot welds 10 provided near the side surfaces 11 of the pole shoes because this is where the tension of the pole shoes is the greatest. However, additional welding locations may be provided.

Figure 5:
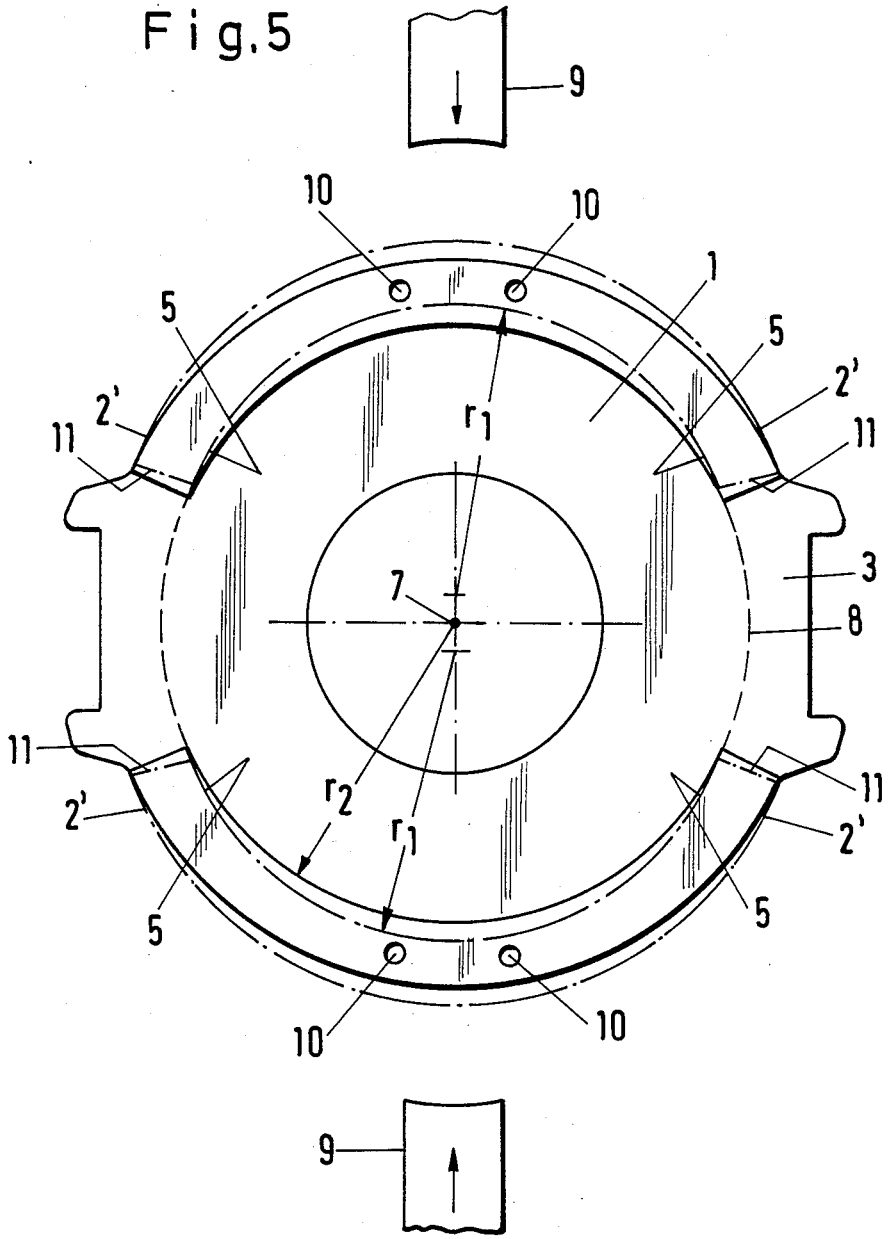
FIG. 5 is a top view of another embodiment of the magnet arrangement according to the invention.

In the embodiment of the present invention illustrated in FIG. 5, the inner radius r1 of the pole shoes is smaller than the radius r2 of the outer surface 8 of the magnet. Again, the center point of the radius r1 is somewhat offset relative to the center point 7 of the entire magnet arrangement. Initially, the pole shoes assume a position relative to the magnet which is illustrated in FIG. 5 in dash-dot lines. In this case, the pressing devices or tools 9 are located approximately in the middle of the pole shoes. By moving the devices 9 in the direction of the arrows, the pole shoes are pressed against the magnet and the radii r1 and r2 become the same. Subsequently, the cover plates 3 are placed on the magnet and pole shoes and the cover plates are welded to the pole shoes. In this case, the spot welds 10 are located approximately in the middle of the pole shoes because this is where the tension of the pole shoes is the greatest. In this embodiment, the number of spot welds 10 may also be different from that illustrated.

The present invention makes it possible to use an unpolished or an only coarsely polished magnet 1. In spite of great tolerances, the pole shoes are capable of holding the magnet concentrically in the measuring elements. This makes possible to reduce the price of the magnet by half which at present represents up to 50% and more of the cost of the materials of a measuring element.

Magnet 1 is a permanent magnet. The pole shoes 2 are of a magnetically very conductive material, such as, pure iron. The cover plates 3 may be of an essentially magnetically non-conductive material.

While specific embodiments of the invention have been shown and described in detail to illustrate the application of the inventive principles, it will be understood that the invention may be embodied otherwise without departing from such principles.

I claim:

1. A method of making a magnet arrangement, including a cylindrical magnet, pole shoes surrounding and resting against the magnet, the pole shoes formed of hollow cylinder sections, two cover plates placed on the end faces of the magnet and of the pole shoes, the cover plates connected to the pole shoes, wherein the inner surfaces of the pole shoes facing the magnet have before being placed on the magnet a radius different from the radius of the outer cylindrical surface of the magnet, comprising placing the pole shoes against the magnet, pressing the pole shoes against the magnet until the radius of the outer surface of the magnet and the radius of the inner surfaces of the pole shoes are equal, and welding the cover plates and the pole shoes together.

2. The method according to claim 1, wherein the inner surfaces of the pole shoes before being placed on the magnet have a radius which is greater than the radius of the outer surface of the magnet.

3. The method according to claim 1, wherein the inner surfaces of the pole shoes before being placed on the magnet have a radius which is smaller than the radius of the outer surface of the magnet.

4. The method according to claim 1, wherein the outer surface of the magnet is unpolished.

5. The method according to claim 1, wherein the outer surface of the magnet is coarsely polished.

6. A magnet arrangement comprising a cylindrical magnet having an outer surface, pole shoes formed of hollow cylinder sections having inner surfaces, wherein the inner surfaces of the pole shoes prior to assembly have a radius different from the radius of the outer surface of the magnet, the pole shoes resting under tension with their inner surfaces fully against the outer surface of the magnet, cover plates placed on the end faces of the magnet and of the pole shoes, and welded connections connecting the cover plates with the pole shoes.

7. The magnet arrangement according to claim 6, wherein at least one welded connection each is provided near the side surfaces of the pole shoes.

8. The magnet arrangement according to claim 6, wherein the outer surface of the magnet is unpolished.

9. The magnet arrangement according to claim 6, wherein the outer surface of the magnet is coarsely polished.

* * * * *